United States Patent [19]

Nelson

[11] 4,334,364

[45] Jun. 15, 1982

[54] ADJUSTABLE STRAIGHT EDGED DEVICE FOR USE WITH DRAFTING BOARD

[75] Inventor: John E. Nelson, Mountaintop, Pa.

[73] Assignee: Eberhard Faber, Inc., Wilkes-Barre, Pa.

[21] Appl. No.: 115,047

[22] Filed: Jan. 24, 1980

[51] Int. Cl.[3] ..... B43L 13/02

[52] U.S. Cl. ..... 33/438; 33/469

[58] Field of Search ..... 33/438, 468–470, 33/473, 475, 478

[56] References Cited

U.S. PATENT DOCUMENTS

| | | | |
|---|---|---|---|
| 149,590 | 4/1874 | Lyman | 33/468 |
| 903,648 | 11/1908 | Wiles | 33/478 |
| 1,038,008 | 9/1912 | Shotwell | 33/478 |
| 2,445,533 | 7/1948 | Mondron et al. | 33/443 |
| 2,512,821 | 6/1950 | Barber | 33/430 |
| 2,572,197 | 10/1951 | Reed | 33/430 |

FOREIGN PATENT DOCUMENTS

| | | | |
|---|---|---|---|
| 241384 | 11/1911 | Fed. Rep. of Germany | 33/430 |
| 433609 | 7/1947 | Italy | 33/468 |

*Primary Examiner*—Harry N. Haroian

*Attorney, Agent, or Firm*—LeBlanc, Nolan, Shur & Nies

[57] ABSTRACT

An adjustable straight edged device for use with a drafting board includes a straight edged blade which is adjustable to different angular orientations on the drafting board and is positively and precisely aligned in a horizontal orientation across the board. The device includes a platform slidably mounted for movement along one side of the drafting board on which the blade is mounted. The platform includes a pivot pin and preferably guide pins which are disposed to respectively, engage an elongated slot and pins about an end angle provided on the straight edged blade to slidably and pivotally attach the blade to the platform. In an alternative embodiment a single guide pin is used which engages a notch in the straight edged blade. This arrangement allows the straight edged blade to be repeatedly and accurately aligned in its horizontal orientation. A clamping knob is provided on the pivot pin for locking the blade in place on the platform. The device also includes a right angle attachment and a sliding scale adapted for sliding movement along the straight edged blade.

8 Claims, 9 Drawing Figures

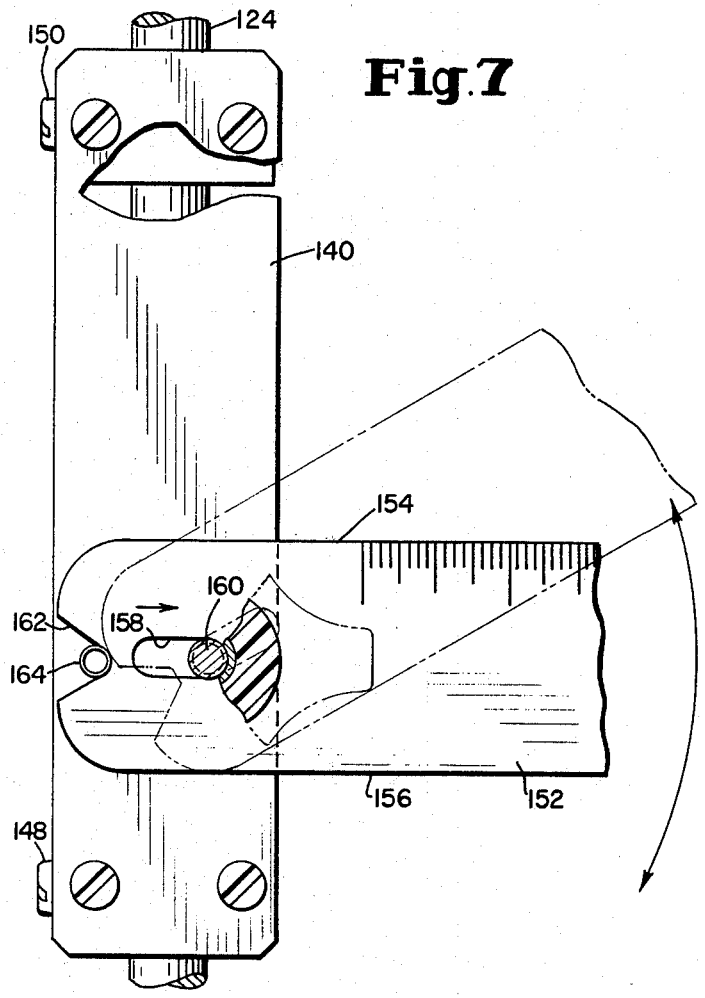
Fig. 7
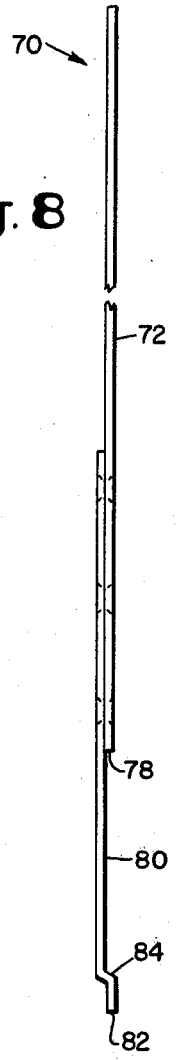
Fig. 8
Fig. 9
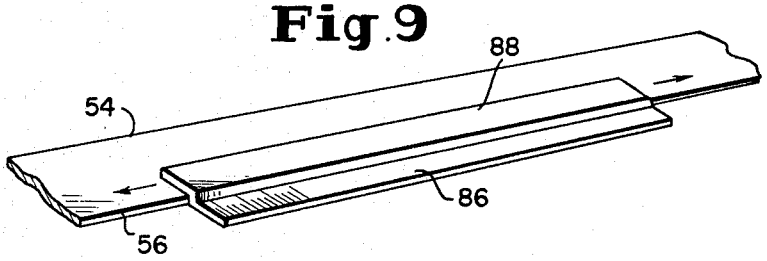

ADJUSTABLE STRAIGHT EDGED DEVICE FOR USE WITH DRAFTING BOARD

The present invention relates to drafting and drawing equipment and, more particularly, to an adjustable straight edged device for use with a drafting board. Specifically, the invention concerns an adjustable straight edged device adapted to be permanently mounted on a drafting board to provide a drafting board assembly in which the straight edged blade is adjustable to different angular positions on the drafting board and is accurately and automatically aligned horizontally across the board to function as a T-square.

Various designs for straight edged drafting tools have been developed in the prior art. For example, it is well known to employ a conventional T-square which is slidable along the edge of a drafting board to allow a draftsman to draw horizontal lines. In addition, it is well known to use traingles with the T-square to draw the lines which are perpendicular or inclined relative to the straight edge of the T-square. To provide more versatility, adjustable straight edged devices have been developed which are adapted to be permanently attached to the drafting board. See, for example, Johnson U.S. Pat. No. 1,569,090, Larson U.S. Pat. No. 2,627,323 and Sykes British Pat. No. 23,008, dated Oct. 9, 1913. Generally, the prior art devices include a guide bar mounted along one side of the drafting board which supports a slidable platform provided with a straight edged blade which is adjustable to different angular orientations. However, with such prior art devices, it is difficult to achieve accurate horizontal alignment of the straight edged blade across the drafting board, particularly when the blade is moved to different angular orientations and returned to its horizontal position. Moreover, the play between the straight edged blade and its support platform will result in inaccurate horizontal alignment, even with the type of T-square disclosed in the Sykes patent. Accordingly, there is need for an adjustable straight edged drafting device which may be adjusted to different angular orientations and also positively and accurately aligned horizontally across the drafting board.

The present invention contemplates an adjustable straight edged device which is self-aligning when its straight edged blade is orientated in its horizontal position across the drafting board. The device advantageously permits the straight edged blade to be infinitely adjustable to different angular orientations on the drafting board, while its self-aligning feature allows the blade to be precisely aligned in its horizontal orientation whenever it is desired to horizontally align the blade across the drafting board. Consequently, the straight edged blade is capable of repeatedly accurate alignment in its horizontal orientation to facilitate precise and accurate drawing operations.

The drafting apparatus of this invention comprises a drafting board, a platform mounted for movement relative to the drafting board, a straight edged blade slidably and pivotably attached to the platform, and guide means cooperable between the blade and the platform for positioning the blade in a desired orientation across the drafting board when the blade is slid into engagement therewith. Preferably, the guide means comprises an angled edge formed at one end of the blade overlapping the platform and guide pins mounted on the platform for guiding the blade into its desired orientations horizontally across the drafting board as the angled surface and the opposed horizontal surface abut or engage the guide pins. In an alternate embodiment a notch is provided at the end of the blade for engaging a single guide pin mounted on the platform. In addition, the apparatus includes means for locking the straight edged blade in place on the platform to prevent movement of the blade relative to the platform.

In a preferred embodiment, the straight edged blade is located to the platform by 3 pins and locking slot connection, e.g., a pivot pin located on the platform and spaced from the guide pins and an elongated slot formed in the blade for slidably and pivotally receiving the pivot pin. The locking means may be embodied as a knob threadably mounted on the pivot pin for clamping the blade against the platform. Preferably, the platform is slidably mounted for movement along one side of the drafting board and is pivotable relative to the drafting board to permit the straight edged blade to be rotated to an inoperative position extending downward at the side of the drafting board.

A preferred embodiment of the adjustable straight edged device comprises a support bar, means for attaching the support bar to the drafting board in a position parallel to one of its sides, a carrier plate slidably mounted for movement along the support bar and provided with a pivot pin and 3 guide pins spaced apart thereon, and a straight edged blade including an elongated slot formed therein for receiving the pivot pin to slidably and pivotally attach the blade to the carrier plate and an end angle formed on the upper surface of the blade cooperable with the elongated slot for receiving the guide pins to maintain the blade in a horizontal orientation across the drafting board disposed between upper and lower guide pins. Preferably, the carrier plate is pivotally mounted on the support bar to permit the straight edged blade to be rotated relative to the board upward out of contact with the drafting board and moved to an inoperative position extending downward at the side of the drafting board. For example, the support bar may be rounded in cross section and the carrier plate may include one or more bearing blocks adapted to slidably and rotatably receive the round bar to pivotally support the carrier plate on the bar. Each bearing block may be adjustable to compensate for wear.

In the preferred embodiment, the support bar is attached to the drafting board by a pair of brackets adapted to be secured to opposite ends of the support bar and fastened underneath the drafting board. The brackets are reversible to allow the support bar to be attached at the right or left side of the drafting board. Preferably, the device includes a right angle accessory adaptable to be slidably mounted on the blade for movement along its horizontal straight edge and provide at least one vertical straight edge. The device also includes a sliding scale which is adapted to be moved along the straight edge of the blade.

Accordingly, a primary object of the invention is to provide an adjustable straight edged device for use with a drafting board including a straight edged blade which is adjustable between different angular orientations and can be accurately aligned in a horizontal orientation across the drafting board.

It is also an object of the invention to provide an adjustable straight edged device in which the straight edged blade is self-aligning to permit the blade to be repeatedly and accurately aligned in its horizontal orientation on the drafting board.

Another object of the invention is to provide a drafting board and straight edged blade combination in which the blade is pivotable upward out of contact with the drafting board into an inoperative position extending downward at the side of the drafting board.

It is another object of the invention to provide an adjustable straight edged device for a drafting board which is simple in design, inexpensive to manufacture, and constructed with a minimum number of components.

These and other objects will be readily apparent with reference to the following drawings and description, wherein:

FIG. 7 is an enlarged plan view of the adjustable straight device illustrating the pivot pin and guide pin employed in the connection of the straight edged blade to the slidable platform of the embodiment of FIG. 4;

FIG. 8 is an enlarged side view of a right-angle accessory which may be used with the adjustable straight edged device; and FIG. 9 is a perspective view of a sliding scale which may be used with the adjustable straight edged device.

Figure 1:
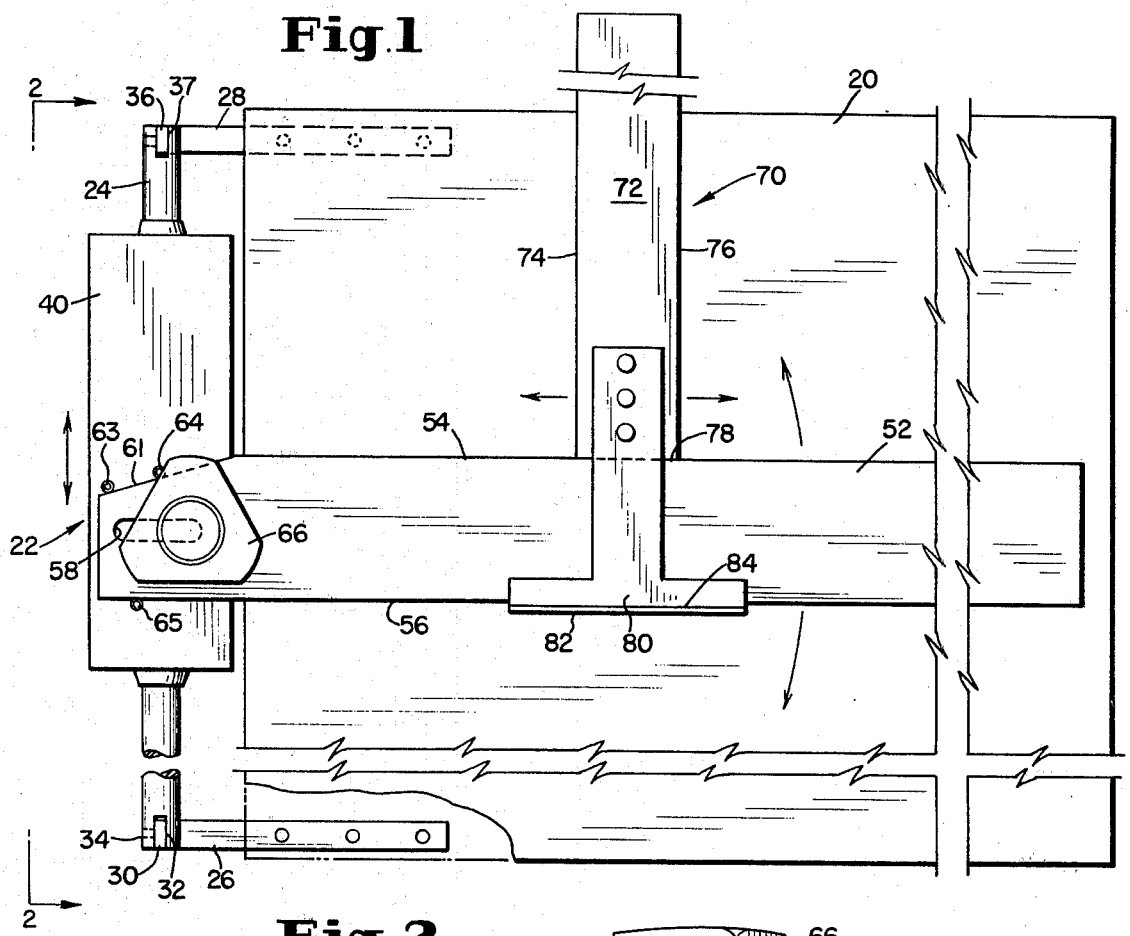
FIG. 1 is a plan view of a drafting board and adjustable straight edged blade combination embodying the principles of a preferred embodiment of this invention.
Figure 2:
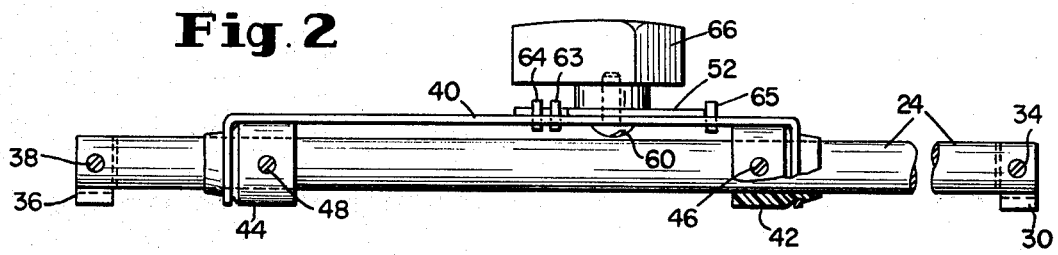
FIG. 2 is an enlarged end view of the adjustable straight edged device taken along line 2—2 of FIG. 1.
Figure 3:
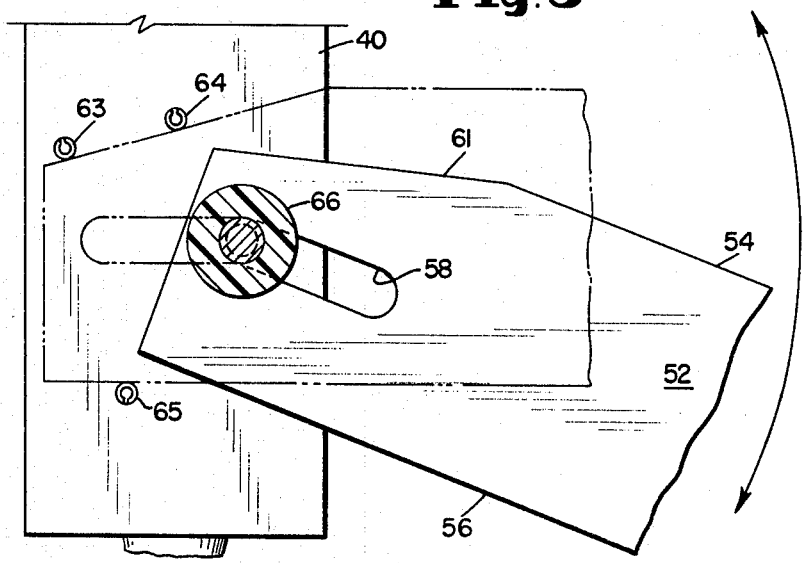
FIG. 3 is an enlarged plan view, partially cut away, of the adjustable straight edged and mounting guide of the embodiment of FIG. 1.

Referring to FIGS. 1–3, and to the preferred embodiment of this invention, a drafting board 20, which is rectangular in configuration, is provided with an adjustable straight edged device, generally 22, which is mounted along one side of the drafting board. It will be understood that drafting board 20 may constitute the top of a drafting table or a separate drafting board.

The adjustable straight edged device includes a support bar 24, e.g., an elongated bar with a round cross section, which is attached to drafting board 20 by a pair of brackets 26 and 28 located at opposite ends of the support bar. Each bracket comprises an elongated metal strip which is adapted to be fastened underneath the drafting board by a set of wood screws. Bracket 26 includes an upstanding flange 30 at its outer end which is received in vertical slot 37 in bar 24. A set screw 38 threaded into the other end of support bar 24 secures flange 36 in slot 37. The elongated vertical slots 32 and 37 and set screws 34 and 38 permit vertical adjustment of support bar 24 for use with drafting boards of different thickness. Brackets 26 and 28 are reversible to permit support bar 24 to be attached at the right or left side of the drafting board.

Adjustable straight edged device 22 includes a platform or carrier plate 40 slidably mounted on support bar 24 by a pair of bearings 42 and 44 (FIG. 2) located at opposite ends of the carrier plate. The bearings 42 and 44 include adjustment set screws 46 and 48 threadably connected to the bearings to adjust the clamping pressure on the support bar and compensate for wear.

As shown in FIG. 1, an elongated blade 52, including parallel upper and lower straight edges 54 and 56, is mounted on carrier plate 40. Blade 52 includes an elongated longitudinal slot 58 formed adjacent to the end of the blade overlapping carrier plate 40 for receiving an upstanding pivot pin 60 mounted on the carrier plate. The pin and slot connection slidably and pivotally connects straight edged blade 52 to carrier plate 40. In addition, surface 54 terminates in an angled surface 61 formed at the end of blade 52. The angle of surface 61 is preferably about 15° to the longitudinal axes of blade 52. A pair of upstanding guide pins 63 and 64 are located on carrier plate 40 and disposed at a corresponding angle so that when blade 52 is disposed horiziontally across board 20 surface 61 abuts pins 63 and 64. Further support in the horizontal position is provided by pin 65 similarly mounted on plate 40 to abut surface 56 when blade 52 is in a horizontal position. As a result, straight edged blade 52 is oriented perpendicularly to carrier plate 40 with guide pins 63 and 64 and 65 abutting surfaces 56 and 61. Additional guide pins could be provided as desired within the scope of this invention.

In a preferred embodiment, a manual clamping knob 66 is provided for locking straight edged blade 52 in place to permit movement of the blade relative to carrier plate 40. Preferably, knob 66 is threadably mounted on pivot pin 60 which comprises a threaded screw member.

Normally, a straight edged blade 52 is clamped against carrier plate 40 by knob 66 in a horizontal orientation extending across drafting board 20. In its horizontal orientation, blade 52 is slid to the left, as shown in FIG. 3, with pivot pin 60 located at the right hand extremity of slot 58 and surfaces 61 and the end portion of 56 received between pins 63, 64 and 65. The pivot pin and guide pin serve to precisely align blade 52 in its horizontal orientation. The straight edged blade is moved into different horizontal positions by sliding carrier plate 40 along support bar 24.

When it is desired to change the angular orientation of straight edged blade 52, knob 66 is loosened to unclamp the blade. Then, blade 52 is slid rightward to position pivot pin 60 at the left hand extremity of slot 58 and to disengage guide pins 63, 64 and 65. Then, as shown in FIG. 3, blade 52 can be pivoted about pivot pin 60 into a desired angular orientation and again clamped against carrier plate 40 by tightening knob 66. The inclined blade can be shifted into different positions on drafting board 20 by sliding carrier plate 40 along support bar 24. Blade 52 is infinitely adjustable to different angular positions over a range exceeding 180°.

To return blade 52 to its horizontal position, knob 66 is loosened and the blade is pivoted about pivot pin 60 to a horizontal position. Next, blade 52 is slid leftward to position pivot pin 60 at the right hand extremity of slot 58. As the blade is slide leftward, pins 63, 64 and 65 abut surfaces 61 and 56, and automatically and precisely align the blade in a horizontal orientation. Then, knob 66 is tightened to clamp blade 52 against carrier plate 40. Pins 63, 64 and 65 and surfaces 61 and 56 provide a guide arrangement which achieves repeatedly accurate alignment of blade 52 in its horizontal position when the blade is returned from any other angular orientation.

Figure 4:
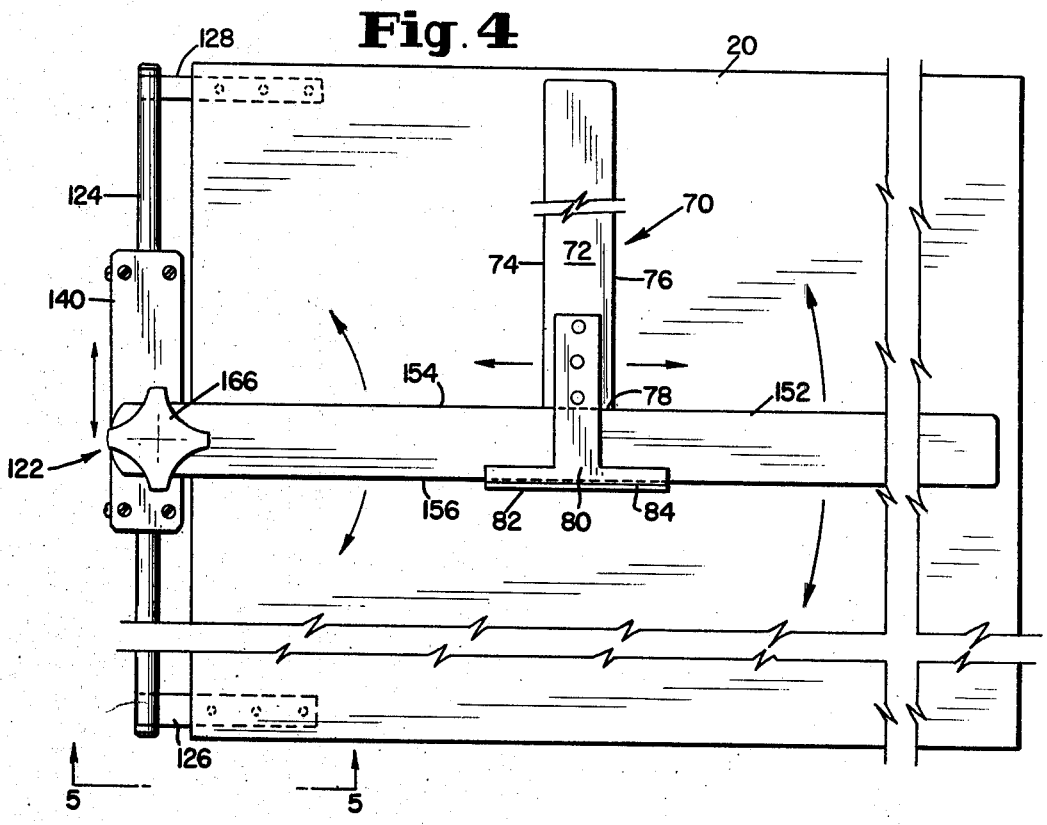
FIG. 4 is a plan view similar to FIG. 1 illustrating an alternative embodiment of the adjustable straight edged blade combination of this invention.

Referring to FIG. 4, in an alternative embodiment drafting board 20 is similarly provided with an adjustable straight edged device, generally 122, which is mounted along one side of the drafting board.

The adjustable straight edged device includes a support bar 124, e.g., an elongated bar with a round cross section, which is attached to drafting board 20 by a pair of brackets 126 and 128 located at opposite ends of the support bar. Each bracket comprises an elongated metal strip which is adapted to be fastened underneath the drafting board by a set of wood screws or other suitable method of attachment. Bracket 126 includes an upstanding flange 130 at its outer end provided with an elongated vertical slot 132 which slidably receives a screw 134 threaded into one end of support bar 124. Similarly, bracket 128 includes an upstanding flange 136 provided with an elongated vertical slot (not shown) which receives a screw 138 threaded into the other end of support bar 124. The elongated vertical slots provided in flanges 130 and 136 permit vertical adjustment of support bar 124 for use with drafting boards of different thickness. Brackets 126 and 128 are reversible to permit support bar 124 to be attached at the right or left side of the drafting board.

Figure 5:
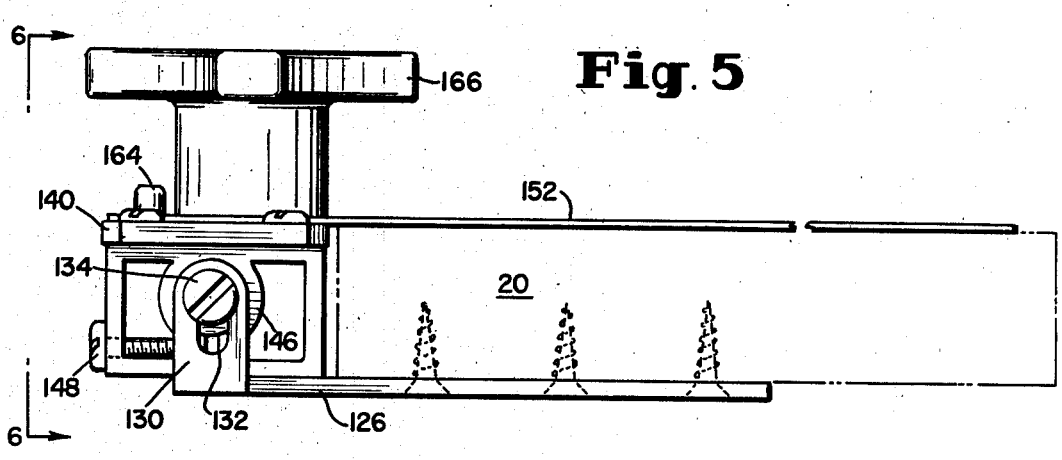
FIG. 5 is an enlarged end view of the adjustable straight edged device taken along line 5—5 of FIG. 4.
Figure 6:
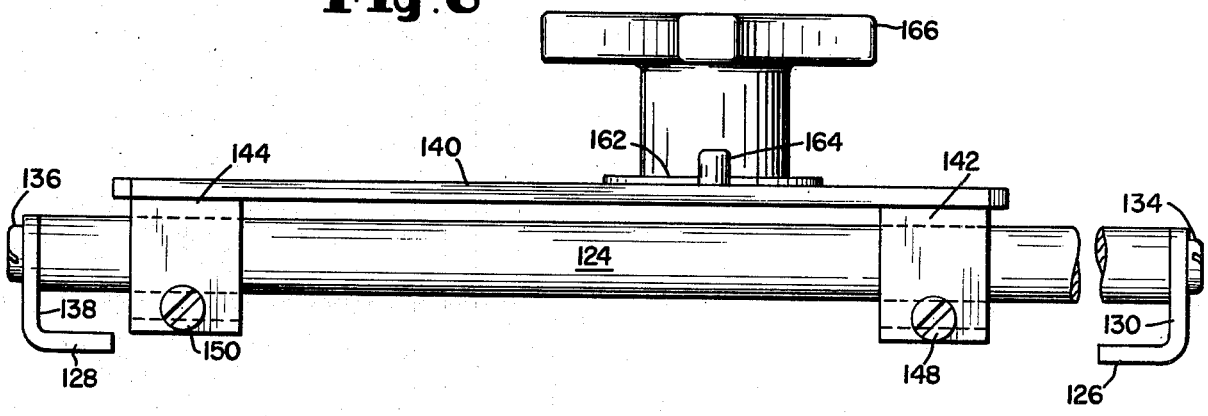
FIG. 6 is an enlarged side view of the adjustable straight edged device taken along line 6—6 of FIG. 5.

Adjustable straight edged device 122 includes a platform or carrier plate 140 slidably mounted on support bar 124 by a pair of bearing blocks 142 and 144 (FIG. 6) located at opposite ends of the carrier plate. As shown in FIG. 5, bearing block 142 is hollow and rectangular in configuration and includes a set of semicircular bearing elements 146 which slidably receive the support bar. The bearing block includes adjustment screw 148 threadably connected to bearing elements 146 to adjust the clamping pressure on the support bar and compensate for wear. Bearing block 144 is similarly constructed and provided with an adjustment screw 150 for the same purpose.

As shown in FIG. 4, an elongated blade 152, including parallel straight edges 154 and 156, is mounted on carrier plate 140. Blade 152 includes an elongated longitudinal slot 158 (FIG. 7) formed adjacent to the end of the blade overlapping carrier plate 40 for receiving an upstanding pivot pin 160 provided on the carrier plate. The pin and slot connection slidably and pivotally connects straight edged blade 152 to carrier plate 140. In addition, an end notch 162 is formed at the end of blade 152 in alignment with elongated slot 158 for receiving an upstanding guide pin 164 located on carrier plate 140. Preferably, pivot pin 160 and guide pin 164 are spaced apart in a direction perpendicular to the path of movement of carrier plate 140 along support bar 124. As a result, straight edged blade 152 is oriented perpendicularly to carrier plate 140 with guide pin 164 received in notch 162. Preferably, notch 162 is V-shaped in configuration to guide blade 152 into the desired orientation when the notch is moved into engagement with guide pin 164.

As in the preferred embodiment, a manual clamping knob 166 is provided for locking straight edged blade 152 in place to permit movement of the blade relative to carrier plate 140. Preferably, knob 166 is threadably mounted on pivot pin 160 which comprises a threaded screw member.

Normally, straight edged blade 152 is clamped against carrier plate 140 by knob 166 in a horizontal orientation extending across drafting board 20. In its horizontal orientation, blade 152 is slid to the left, as shown in FIG. 7, with pivot pin 160 located at the right hand extremity of slot 158 and guide pin 164 received in V-shaped notch 162. The pivot pin and guide pin serve to precisely align blade 152 in its horizontal orientation. The straight edged blade is moved into different horizontal positions by sliding carrier plate 140 along support bar 124.

When it is desired to change the angular orientation of straight edged blade 152, knob 166 is loosened to unclamp the blade. Then, blade 152 is slid rightward to position pivot pin 160 at the left hand extremity of slot 158 and to disengage guide pin 164 from notch 162. Then, as shown in phantom lines in FIG. 7, blade 152 can be pivoted about pivot pin 160 into a desired angular orientation and again clamped against carrier plate 140 by tightening knob 166. The inclined blade can be shifted into different positions on drafting board 20 by sliding carrier plate 140 along support bar 124. Blade 152 is infinitely adjustable to different angular positions over a range exceeding 180°.

To return blade 152 to its horizontal position, knob 166 is loosened and the blade is pivoted about pivot pin 160 to align V-shaped groove 162 with guide pin 164. Next, blade 152 is slid leftward to position pivot pin 160 at the right hand extremity of slot 158. As the blade is slid leftward, V-shaped notch 162 receives guide pin 164 and automatically and precisely guides the blade into its horizontal orientation. Then, knob 166 is tightened to clamp blade 152 against carrier plate 140. V-shaped notch 162 and guide pin 164 provide a guide arrangement which achieves repeatedly accurate alignment of blade 152 in its horizontal position when the blade is returned from any other angular orientation.

As shown in FIGS. 1 and 4, a right-angle, attachment, generally 70, may be provided which is slidable along straight edged blade 52 or 152 to provide vertical straight edges. Right-angle attachment 70 includes a flat blade 72 provided with vertical straight edges 74 and 76 extending along its opposite sides and a flat bottom edge 78 for slidably engaging straight edge 54 or 56 or 154 or 156 of blade 52 or 152. A T-shaped bar 80 is secured, e.g., by a set of rivets, to blade 72 and includes an offset 82 (FIG. 8) which provides a straight guide surface 84 which is parallel to flat bottom edge 78 of the blade. As shown in FIG. 8, flat bottom edge 78 of blade 72 and guide surface 84 are spaced apart by a sufficient distance to receive blade 52 or 152 therebetween and to slidably engage its straight edges 54 and 56 or 154 or 156. If desired, right angle attachment 70 may be reversed from its orientation shown in FIGS. 1 and 4 to extend downwardly from straight edged blade 52.

As shown in FIG. 9, a sliding scale 86 may be provided which is slidable along straight edged blade 52 or 152. Sliding scale 86 includes an offset portion 88 which overlaps blade 52 or 152 and guides the scale in its movement along straight edge 54 or 56 or 154 or 156.

Referring to FIGS. 3 and 5, bearing elements 42, 44 and 46 not only slidably mount each bearing block on support bars 24 and 124, but also allow the bearings and platforms 40 and 140 to pivot about the axis of the support bar. Thus, platforms 40 and 140 are pivotable relative to drafting board 20 to permit straight edged blades 52 and 152 to be pivoted upward out of contact with the drafting board and moved to an inoperative position extending downward at the side of the drafting board when the blade is not in use.

In conclusion, the present invention provides an adjustable straight edged device for use with a drafting board which is readily adjustable between different angular orientations and is positively and precisely aligned in a horizontal orientation across the drafting board. The adjustable straight edged device is simple in construction and includes a minimum number of components. The straight edged blade is adjustable over a wide range of angular positions. The guide arrangements formed in the blade, which cooperate with the pivot pin and guide pin(s) provided on the carrier plate, achieve repeatedly accurate self-alignment of the blade in its horizontal orientation. Further, when desired, the straight edged blade can be advantageously flipped over into an inoperative position extending downward at the side of the drafting board.

While a specific embodiments of the invention have been shown and described in detail, it will be understood that the invention may be modified without departing from the spirit of the inventive principles set forth in the appended claims.

I claim:

1. An adjustable straight edged device for use with a drafting board, comprising:

a support bar;

means for attaching said support bar to the drafting board in a position parallel to one of its sides;

a carrier plate slidably mounted for movement along said support bar and provided with a pivot pin and three guide pins spaced apart thereon; and a straight edged blade including an elongated slot extending coaxially with a portion of the longitudinal axis of said blade, formed at an end thereof, for receiving said pivot pin to slidably and pivotally attach said blade to said carrier plate, one end edge portion of said blade forming an acute angle with the longitudinal axis of said blade in alignment with said elongated slot with two of said guide pins being disposed to abut the angled edge portion while the third of said pins abuts an opposite edge of said blade to maintain said blade in a horizontal orientation across the drafting board extending at a perpendicular angle from said support bar when the edges thereof abut said pins.

2. The device of claim 1, which includes:

means for locking said blade in place on said plate to prevent movement of said blade relative to said plate.

3. The device of claim 2, wherein said locking means comprises:

a knob threadably mounted on said pivot pin for clamping said blade against said carrier plate.

4. The device of claim 2, wherein:

said carrier plate is pivotally mounted on said support bar to permit said blade to be pivoted upward out of contact with the drafting board and moved to an inoperative position extending downward at the side of the drafting board.

5. The device of claim 1, wherein:

said support bar is round in cross section; and said carrier plate includes one or more bearings adapted to slidably and rotatably receive said round bar to pivotally support said carrier plate on said bar.

6. The device on claim 5, wherein:

each bearing is adjustable to compensate for wear.

7. The device of claim 1, which includes:

a right-angle attachment adapted to be slidably mounted on said blade for movement along its horizontal straight edge and provide at least one vertical straight edge, 8. The device of claim 1, wherein said attaching means comprises:

a pair of brackets adapted to be secured to opposite ends of said support bar and fastened underneath the drafting board.

* * * * *